US007942705B2

(12) United States Patent
Murphy et al.

(10) Patent No.: US 7,942,705 B2
(45) Date of Patent: May 17, 2011

(54) AUDIO JACK WITH POGO PINS FOR CONDUCTIVE CONTACTS

(75) Inventors: Sean Murphy, Sunnyvale, CA (US); John DiFonzo, Emerald Hills, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/482,326

(22) Filed: Jun. 10, 2009

(65) Prior Publication Data

US 2010/0240259 A1 Sep. 23, 2010

Related U.S. Application Data

(60) Provisional application No. 61/162,210, filed on Mar. 20, 2009.

(51) Int. Cl.
*H01R 24/04* (2006.01)

(52) U.S. Cl. ..... 439/668; 439/700

(58) Field of Classification Search ..... 439/668, 439/700, 669, 824

See application file for complete search history.

(56) References Cited

U.S. PATENT DOCUMENTS

| | | | | |
|---|---|---|---|---|
| 3,289,149 | A * | 11/1966 | Pawloski | 439/669 |
| 4,904,213 | A * | 2/1990 | Hock et al. | 439/824 |
| 7,322,858 | B1 * | 1/2008 | Rogers et al. | 439/669 |
| 7,377,822 | B1 * | 5/2008 | Shen | 439/700 |
| 2005/0026510 | A1 * | 2/2005 | Orihara | 439/700 |
| 2006/0052011 | A1 * | 3/2006 | Goodman et al. | 439/700 |

* cited by examiner

*Primary Examiner* — Ross N Gushi

(74) *Attorney, Agent, or Firm* — Kramer Levin Naftalis & Frankel LLP

(57) ABSTRACT

An audio jack can allow electrical connections between an audio plug and an electronic device. The audio jack can include a series of pogo pins operative to extend into an audio jack cavity to provide conductive contacts for an audio plug placed within the audio jack. When an audio plug is inserted in the audio jack, the deflectable tips of each pogo pin can deflect and contact audio plug contact portions or regions. The end of the pogo pins opposite the deflectable tips can be coupled to an appropriate electronic device component, such as a printed circuit board, flex circuit, cable, or any other suitable component to provide a conductive path for signals between the audio plug and the electronic device.

20 Claims, 4 Drawing Sheets

AUDIO JACK WITH POGO PINS FOR CONDUCTIVE CONTACTS

CROSS-REFERENCE TO RELATED APPLICATION

This application claims priority to U.S. Provisional Application No. 61/162,210, filed Mar. 20, 2009, which is incorporated by reference herein in its entirety.

BACKGROUND OF THE INVENTION

This is directed to an audio jack using pogo pins to provide a low profile assembly.

Many electronic devices include audio jacks for providing audio generated by electronic device circuitry to an audio output component coupled to the device. For example, many portable electronic devices include audio jacks to which headphone or speaker audio plugs can connect to transfer signals carrying the audio. Audio jacks include several conductive pads operative to contact audio plug contact portions or regions to provide electrical paths through which audio signals, power signals, and data signals can be transferred. The conductive pads typically can be formed from stamped sheet metal and can be shaped in a manner to ensure electrical contact and retention when an audio plug is inserted in the audio jack. Suitable shapes can include, for example, cantilever beams extending into an audio jack cavity and operative to deflect away from an audio plug when the audio plug is inserted in the audio jack.

The cantilever beam, however, can take up large amounts of space within the audio jack assembly. In particular, a cantilever beam can require a substantial minimum length for ensuring that the force generated by the beam deflection is sufficient to maintain the beam in contact with an audio plug contact portion. In addition, the cantilever beam requires space in at least two dimensions, which can prevent the size of an electronic device from being reduced. This can especially be an issue for electronic devices so small that the audio jack size effectively determines the size of the device.

SUMMARY OF THE INVENTION

An audio jack having pogo pins to provide conductive contacts with audio plug contact portions is provided.

The audio jack can include a cavity into which an audio plug can be inserted. A series of pogo pins can extend into the cavity to provide conductive contacts for audio plug contacts. When an audio plug is inserted in the audio jack, the deflectable tips of each pogo pin can sequentially deflect to allow the audio plug to be inserted into the cavity. The end of the pogo pins opposite the deflectable tips can be coupled to an appropriate electronic device component to transfer signals, such as a printed circuit board, flex circuit, cable, or any other suitable component.

The pogo pins can be positioned in the audio jack using any suitable orientation. In some embodiments, the pogo pins can be positioned in substantially a single plane such that the pogo pins require space in a single dimension of the audio jack assembly. The pogo pins can be oriented substantially orthogonal to the audio jack cavity (e.g., such that the deflectable tips extend orthogonally into the cavity), or at an angle relative to the cavity walls. In particular, it may be desirable to orient the pogo pins at an angle to prevent or reduce the chances that an audio jack snags on a deflectable tip upon insertion or removal.

The audio jack can include any suitable number of pogo pins. For example, the audio jack can include at least one pogo pin for each conductive portion of an audio plug inserted within the audio jack (e.g., four pins for each of the microphone, left, right and ground channels). As another example, the audio jack can include several pogo pins for a single audio plug conductive portion, for example as a detect mechanism (e.g., two pogo pins for the distal-most conductive portion, for example associated with the ground).

The pogo pins can have any suitable dimension. In particular, the pogo pin dimensions can be selected based on the size of the audio plug contact portions, the distance between the audio jack cavity and an electronic device component, or any other criteria. In some embodiments, a characteristic dimension of the deflectable tip (e.g., a diameter or radius of the tip) can be less than the maximum amount by which the deflectable tip can extend into the cavity.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

Embodiments of the following discussion will be described in the context of an audio jack. It will be understood, however, that features of the described embodiments can be applied to any suitable electronic connector, including for example an axial jack or connector (e.g., cylindrical axial jack for a cylindrical axial plug) for which pogo pins extend substantially orthogonal to the surface of the connector. Any suitable electronic or electrical plug can be placed within the electronic connector.

Figure 1:
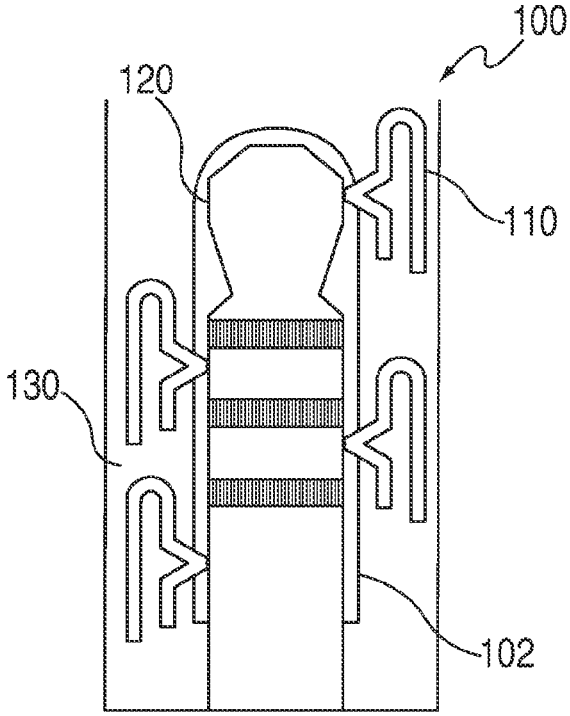
FIG. 1 is a schematic view of an illustrative audio jack and plug having stamped contact pads.
Figure 2:
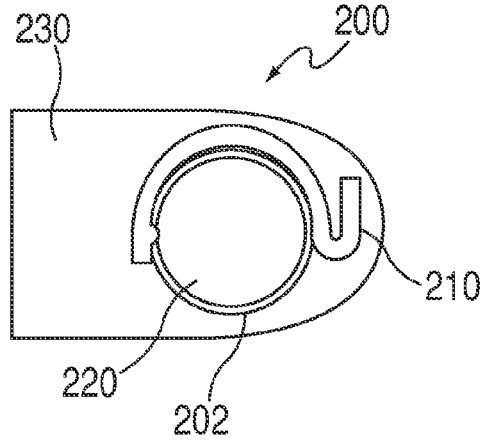
FIG. 2 is a schematic view of another illustrative audio jack and plug having stamped contact pads.

An audio jack can include several contact pads operative to electrically couple the conductive portions of an audio plug to electronic device components. The contact pads can take any suitable form. In some known embodiments, the contact pads can be constructed from pressed sheet metal and positioned such that they provide cantilever spring contacts for the audio plug. FIG. 1 is a schematic view of an illustrative audio jack and plug having stamped contact pads. Audio jack 100 can include cavity 102 into which audio plug 120 can be inserted. To provide an electrical connection between audio plug 102 and the electronic device, audio jack 100 can include cantilever springs 110 positioned along the periphery of cavity 102. The springs can extend from different sides of the cavity, and substantially in the direction of the cavity axis. Cantilever springs 110 can be manufactured using a stamping process, thus creating stamped contact pads. Audio jack 100 can be positioned within housing 130 of an electronic device. FIG. 2 is a schematic view of another illustrative audio jack and plug having stamped contact pads. Audio jack 200 can include a cavity 202 into which audio plug 220 is inserted. To provide an electrical connection between conductive portions of audio plug 220 and the electronic device, curved spring 210 can extend around the circumference of cavity 202 and extend through an opening in the cavity to contact audio plug 220. The length and shape of curved spring 210 can provide sufficient force to maintain a constant electrically conductive path between audio plug 220 and the electronic device. This approach, however, requires curved spring 210 to extend around at least a portion of cavity 202. Audio jack 200 can be positioned within housing 230 of an electronic device.

Figure 3:
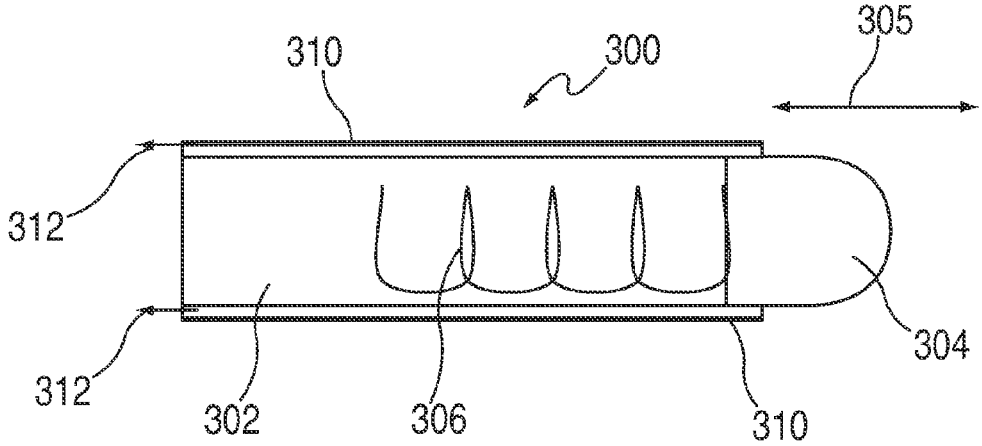
FIG. 3 is a cross-sectional view of an illustrative pogo pin in accordance with one embodiment of the invention.

When audio jacks such as those described in FIGS. 1 and 2 are positioned near an edge of an electronic device or boundary of an electronic device housing (e.g., housing 130 of FIG. 1 or housing 230 of FIG. 2), the contact pads can require space that increases the overall size of the housing (e.g., space in at least two dimensions). In particular, the housing cannot be placed against the audio jack cavity wall. If the contact pads contacted and moved within the audio jack cavity from a single plane on a single side of the electronic device, however, the electronic device housing could be shrunk around audio jack cavity on up to three sides (e.g., closely follow a 180 degree section of the audio jack cavity). In some embodiments of the invention, a pogo pin can be used to provide a contact pad that can be placed in a single plane and deflect linearly. FIG. 3 is a cross-sectional view of an illustrative pogo pin in accordance with one embodiment of the invention. Pogo pin 300 can include body 302 from which retractable portion 304 can extend. During use, retractable portion 304 can linearly deflect into a cavity of body 302 (e.g., along arrows 305) when a load is applied to retractable portion 304. To maintain an electrically conductive contact with a component positioned against retractable portion 304, pogo pin 300 can include spring 306 placed within the cavity of body 302 and pushing retractable portion 304 out of the body.

To provide an electrically conductive path between the tip of retractable portion 304 and electronic device components coupled to the pogo pin (e.g., coupled via connections 312), body 302 can include conductive paths 310 extending within and along the length of body 302. Using conductive paths 310 instead of spring 306 to conduct signals through pogo pin 300 can reduce the impedance and resistance of the electrical path between the ends of pogo pin 300. The size and materials used for pogo pin 300 can be selected based on any suitable criteria, including for example the amount of current to pass through the pin, the size of the contact regions that retractable portion 304 contacts, the type of load applied to retractable portion 304, or any other suitable criteria. Similarly, different criteria can be used to select the type of spring 306 used, including for example the expected amount of the load, required retention forces by pogo pin 300, impedance and resistance concerns, or any other suitable criteria.

Figure 4:
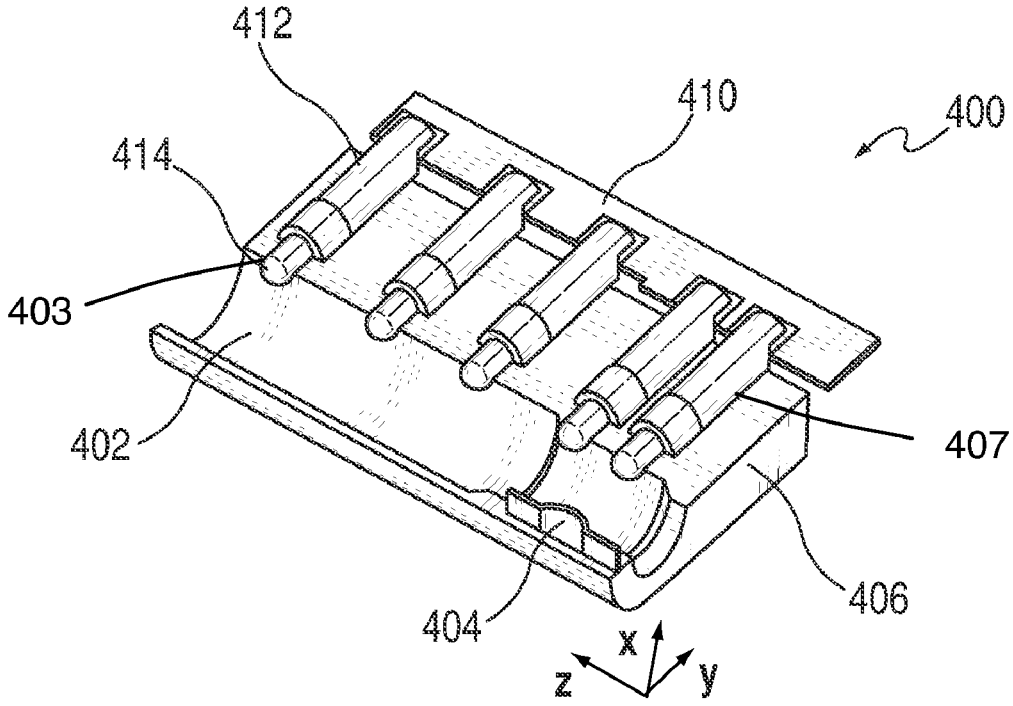
FIG. 4 is a schematic view of an illustrative cross-section of an audio jack having a pogo pin in accordance with one embodiment of the invention.
Figure 5:
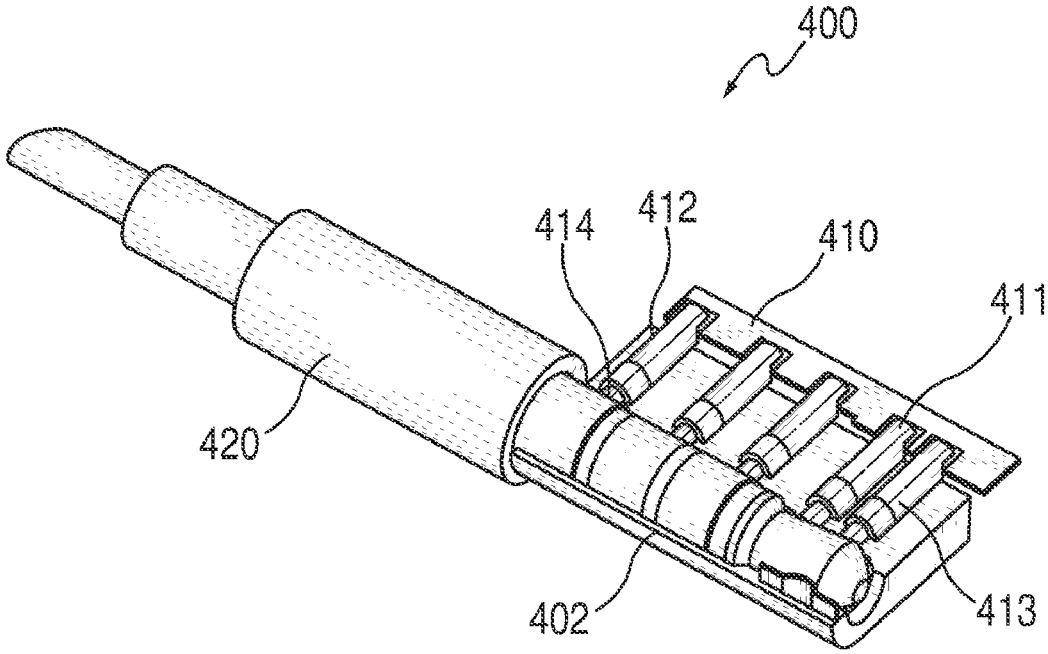
FIG. 5 is a schematic view of an illustrative cross-section of the audio jack of FIG. 4 into which an audio plug is inserted in accordance with one embodiment of the invention.
Figure 6:
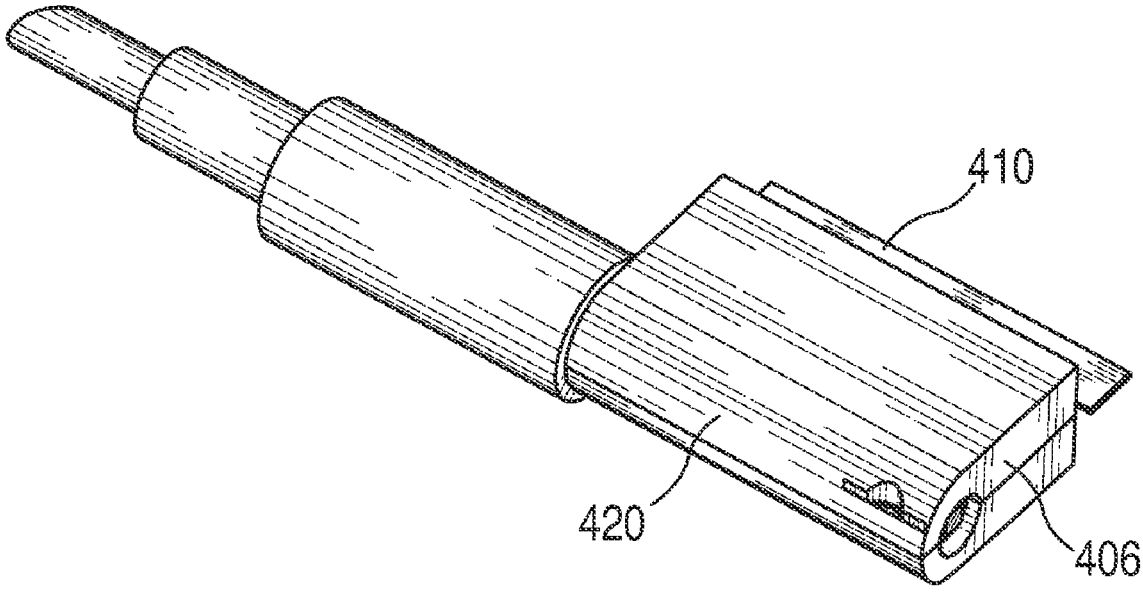
FIG. 6 is a schematic view of the illustrative audio jack of FIG. 4 in accordance with one embodiment of the invention.

Although the following discussion will describe the use of pogo pins in the context of an audio jack, it will be understood that such pogo pins can be used in any electronic device port for connecting to any suitable plug. The plug and port can transfer signals representing any suitable information, including for example audio, data, power, or any other types of information. A pogo pin can be implemented in an audio jack using any suitable approach. FIG. 4 is a schematic view of an illustrative cross-section of an audio jack having a pogo pin in accordance with one embodiment of the invention. FIG. 5 is a schematic view of an illustrative cross-section of the audio jack of FIG. 4 into which an audio plug is inserted in accordance with one embodiment of the invention. FIG. 6 is a schematic view of the illustrative audio jack of FIG. 4 in accordance with one embodiment of the invention. Audio jack 400 can include cavity 402 into which audio plug 420 can be inserted. Cavity 402 can be formed within body 406 of audio jack 400. Pogo pins 412 can extend into body 406 to provide an electrical connection for an audio plug inserted in the cavity.

To retain audio plug 420 within the cavity, audio jack 400 can include internal retention mechanism 404 positioned opposite pogo pins 412, such that audio plug 420 is restrained between retention mechanism 404 and pogo pins 412. Retention mechanism 404 can include any suitable mechanism for providing a retention force on an audio plug inserted in the cavity, including for example a spring positioned within cavity 402. The strength of retention mechanism 404 can be selected based on any suitable criteria, including for example the required retention force, the space available within cavity 402, and the size of the audio plug component against which retention mechanism 404 rests. In some embodiments, retention mechanism 404 may not be necessary if pogo pins 412 provide a sufficient retention force.

Body 406 can be formed from any suitable component. In some embodiments, body 406 can be formed from a single component (e.g., molded), or from several components combined and assembled to create body 406. For example, body 406 can include at least two portions each defining a portion of cavity 402 (e.g., two halves) that are combined. As another example, body 406 can be formed from a tubular section defining the cavity to which other sections retaining pogo pins (e.g., pogo pins 412) can be coupled. Any suitable approach can be used to assemble distinct portions, including for example an adhesive, tape, heat staking, a mechanical fastener, or another approach).

Audio jack 400 can include pogo pins 412 embedded within body 406 and at least partially extending within cavity 402. In particular, retractable portion 414 of each pogo pin 412 can extend into cavity 402 via an opening (e.g., opening 403) such that, when audio plug 420 is inserted in cavity 402, retractable portion 414 is depressed and contacts audio plug 420. Pogo pins 412 can be coupled to body 406 using any suitable approach, including for example an adhesive, tape, press fit (e.g., in a nylon body), heat staking, a mechanical fastener, as a manufacturing process (e.g., mold body 406 around pogo pins 412), or any other suitable approach. In some embodiments, pogo pins 412 can be placed within a notch of body 406 (e.g., notch 407).

Figure 7:
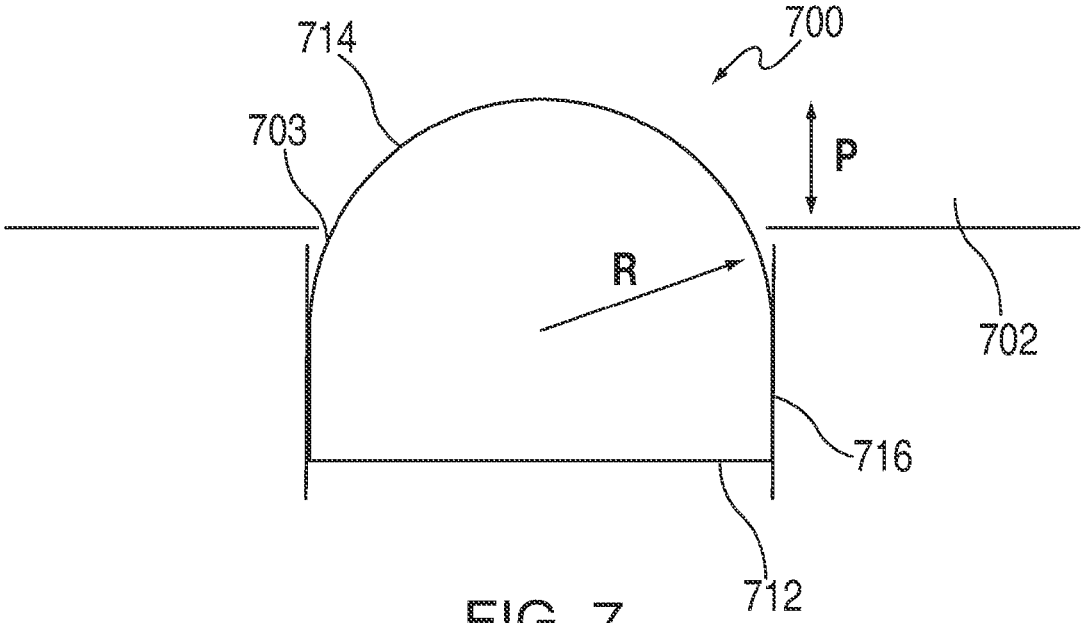
FIG. 7 is a cross-sectional view of an illustrative retractable portion of a pogo pin in accordance with one embodiment of the invention.

To prevent an audio plug from stubbing against a retractable portion 414 of a pogo pin 412 upon insertion or removal, retractable portion 414 can extend into cavity 402 by a maximum amount. FIG. 7 is a cross-sectional view of an illustrative retractable portion of a pogo pin in accordance with one embodiment of the invention. Pogo pin 700 can include body 712 from which retractable portion 714 can extend. Pogo pin 700 can be positioned such that retractable portion 714 can extend through opening 703 in the side wall of cavity 702 (which is part of the audio jack). To reduce the chance of stubbing, radius R of the retractable portion can be selected to be smaller than protrusion P by which retractable portion 714 can extend into cavity 702. This can in turn prevent an audio plug from contacting straight edge 716 of retractable portion 714, but instead always contact the curved tip over which the audio plug can more easily slide.

Returning to FIGS. 4-6, audio jack 400 can include any suitable number of pogo pins 412. For example, audio jack 400 can include one pogo pin for each contact portion of an audio jack (e.g., the pogo pins can extend through openings in the cavity that are aligned with the audio plug contact portion positions). In the example of FIG. 4, audio jack 400 includes at least one pogo pin for each of the four conductive portions of audio plug 420. As another example, audio jack 400 can include secondary pogo pins 412 to serve as plug detects. In the example of FIG. 4, audio jack 400 can include pogo pin 413 operative to detect the presence of the distal most conductive portion of audio jack 420 (e.g., a connection between pogo pin 413 and the pogo pin 411 associated with the distal conductive portion of audio plug 420 shorts when audio plug 420 is fully inserted in audio jack 400). In some embodiments, audio jack 400 can include additional pogo pins 412, including for example pogo pins operative to detect each of the conductive portions of audio plug 420.

The individual pogo pins 412 can provide electrical signals to the electronic device using any suitable approach. In some embodiments, each pogo pin 412 can be coupled to one or more circuit boards, flex circuits, wires, or any other electronic device component (e.g., audio output circuitry). For example, each pogo pin 412 can be coupled to a circuit board 410 for transferring signals between audio plug 420 and the electronic device.

Pogo pins 412 can be distributed within audio jack 400 using any suitable approach. In some embodiments, pogo pins 412 can be distributed substantially within a single plane or along a single dimension of the electronic device. In the example of FIGS. 4-6, pogo pins 412 are distributed in a plane that includes the axis of cavity 402. In addition, because by construction pogo pins move linearly or axially in the axis of the pogo pin, the pogo pin motion as an audio plug is inserted in an audio jack can remain in the plane and along the axis of the pogo pins (e.g., as opposed to the stamped metal contact pads of audio jacks 100 (FIG. 1) and 200 (FIG. 2). This can allow the audio jack dimensions to be greatly reduced in two dimensions (e.g., along the axis of the cavity, or z, and in one direction perpendicular to the axis of the cavity, or x). In particular, the contact mechanism for the audio jack only needs to extend in one direction (e.g., in one direction perpendicular to the axis of the cavity, or y). This may allow an electronic device in which the electronic device housing follows the dimensions of the audio jack for around at least one half of the periphery of the audio jack (e.g., all of the audio jack conductive pads and the movement of the audio jack conductive pads remains in a plane that includes the central axis of the cavity).

Figure 8:
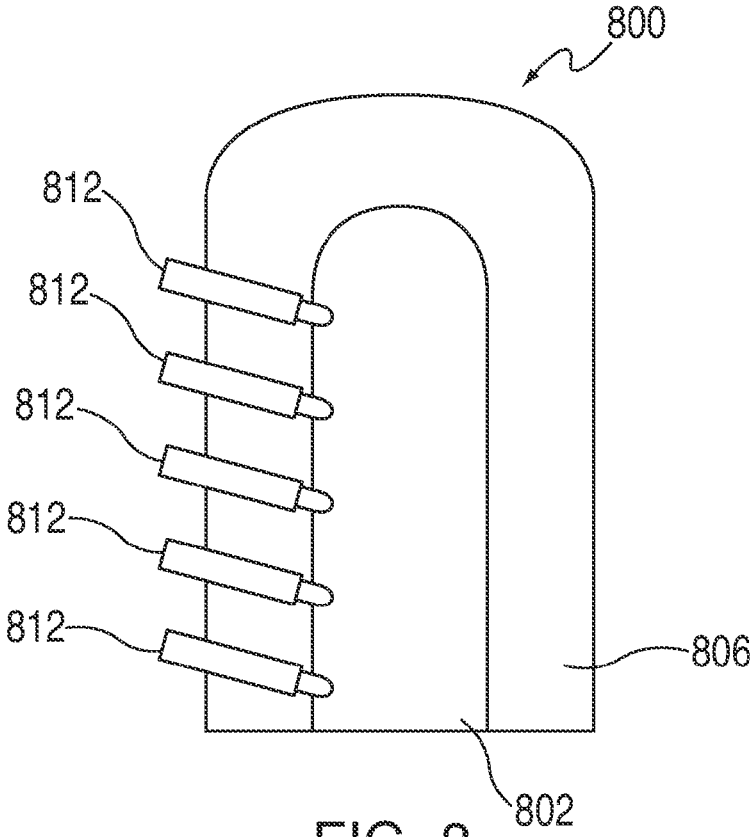
FIG. 8 is a schematic view of an illustrative cross-section of an audio jack having angled pogo pins in accordance with one embodiment of the invention.

Because the force applied to pogo pins 412 is not a purely axial force (e.g., a force along the main axis of pogo pin 412) but a force that includes at least a substantial side loading component, the pogo pins can be positioned at an angle relative to cavity 402. FIG. 8 is a schematic view of an illustrative cross-section of an audio jack having angled pogo pins in accordance with one embodiment of the invention. Audio jack 800 can include cavity 802 operative to receive an audio plug. Cavity 802 can be defined within body 806 of the audio jack. To provide an electrical connection between electronic device components and the audio plug, audio jack 800 can include pogo pins 812 extending at least partially into cavity 802. To reduce the side load and increase the axial load on pogo pins 812, pogo pins 812 can be angled relative to the surface of cavity 802. For example, pogo pins 812 can be angled towards the opening of cavity 802. As another example, pogo pins 812 can be angled away from the opening of cavity 802. Pogo pins 812 can be positioned at any angle relative to the surface of cavity 802, including for example an angle in the range of 5 to 60 degrees, 10 to 50 degrees, 15 to 40 degrees, or 20 to 25 degrees towards or away from the cavity opening. In some embodiments, the side and travel of the deflecting portion of each pogo pin 812 can be selected based on the angle of the pogo pin relative to the cavity wall.

In some embodiments, the audio jack can include conductive pad assemblies other than pogo pins, although the pogo pins described herein can constitute a variety of conductive pad assembly (e.g., conductive pad assembly 412). In particular, the audio jack can include any conductive pad assembly that includes a body and a deflecting component. To reduce the amount of space required by the audio jack in at least two dimensions, the deflecting component can move substantially linearly in and out of the body (e.g., deflecting component 414). To further reduce the amount of space required in a direction along the length of the audio jack, the deflecting component can move in a direction substantially orthogonal or angled relative to elongated cavity of the audio jack (e.g., within a single plane passing through a central axis of the cavity). When an audio plug is inserted in the audio jack, the audio plug can side load the deflecting components, for example load the deflecting components at an angle (e.g., perpendicular or substantially perpendicular) relative to the axis of motion of the deflecting component.

In some embodiments, an electronic device port can include linear contact pads extending from several sides of the port. In particular, an electronic device can include linear contact pads, such as pogo pins, extending from opposite sides of a port and contacting different contact regions of a plug inserted in the port. Because the linear contact pads can require less space along the height of the port, a plug having more distinct contact regions can be used with a smaller port (e.g., the density of contact pads can increase because the space required for a contact pad to move can be limited to a direction away from the port). In some embodiments, combinations of linear contact pads (e.g., pogo pins) and non-linear contact pads (e.g., the stamped pads of FIGS. 1 and 2) can be combined in a single port.

The above described embodiments of the present invention are presented for purposes of illustration and not of limitation, and the present invention is limited only by the claims which follow.

What is claimed is:

1. An electrical connector, comprising:

a body comprising a cavity operative to receive an electrical plug, the body comprising at least one opening in the cavity aligned with at least one position of conductive portions of the electrical plug when the electrical plug is inserted in the electrical connector;

a retention mechanism extending into the cavity and operative to engage a recess of the electrical plug; and at least one pogo pin embedded in the body, wherein the at least one pogo pin comprises:

a pogo pin body housing an internal spring; and a deflecting portion electrically connected to the pogo pin body, wherein the deflecting portion extends through the at least one opening and is operative to deflect and contact the conductive portion of the electrical plug when the electrical plug is inserted in the electrical connector.

2. The electrical connector of claim 1, wherein the body further comprises:

at least one notch aligned with the at least one opening in the cavity and operative to receive the at least one pogo pin.

3. The electrical connector of claim 2, wherein:

the notch comprises an elongated dimension; and the elongated dimension extends in a direction substantially orthogonal to a plane tangent to the at least one opening.

4. The electrical connector of claim 3, wherein:

the notch substantially defines a cylinder; and the elongated dimension defines the height of the cylinder.

5. The electrical connector of claim 3, wherein:

the deflecting portion linearly deflects in the direction of the elongated dimension.

6. An electronic connector, comprising:

a body defining a cavity for receiving an electronic plug;

a plurality of conductive pad assemblies operative to contact the electronic plug, each conductive pad assembly comprising:

a deflecting component operative to extend into the cavity from within the body;

a conductive pad assembly body electrically coupled to the deflecting portion and operative to house the deflecting component; and an internal spring housed within the conductive pad assembly body, wherein the deflecting component linearly deflects into the conductive pad assembly body following a path perpendicular to a plane tangent to the cavity wall; and a retention mechanism extending into the cavity by an amount different from an amount by which the deflecting component extends into the cavity when the electronic plug is received in the cavity.

7. The electronic connector of claim 6, wherein:

the conductive pad assembly body defines an elongated structure substantially aligned with the path of the deflecting component deflection.

8. The electrical connector of claim 6, further comprising:

at least one conductive pad assembly for each conductive portion of the electronic plug.

9. The electronic connector of claim 8, further comprising:

at least two conductive pad assemblies for a single conductive portion of the electronic plug, wherein one of the at least two conductive pad assemblies is operative to detect the electronic plug.

10. The electronic connector of claim 6, wherein:

the plurality of conductive pad assemblies are press fit in the body.

11. The electronic connector of claim 6, wherein:

the plurality of contact pad assemblies are substantially disposed in a plane.

12. An electronic device operative to provide audio output, comprising:

audio output circuitry operative to generate an audio output; and an electrical connector comprising:

a body with a cavity comprising an opening operative to receive an electronic plug; and at least one pogo pin extending linearly into the cavity, wherein the pogo pin comprises a deflecting portion, a pogo pin body electrically coupled to the deflecting portion, and an internal spring positioned within the pogo pin body to bias the deflecting portion, the pogo pin operative to provide an electrically conductive path between the interior of the cavity and the audio output circuitry; and a retention mechanism extending into the cavity by an amount different from an amount by which the deflecting portion extends into the cavity when the electronic plug is received in the cavity.

13. The electronic device of claim 12, wherein:

the cavity comprises a substantially cylindrical cavity around the at least one pogo pin, and the at least one pogo pin is placed in a plane passing through a central axis of the substantially cylindrical cavity.

14. The electronic device of claim 13, wherein:

the electrical connector comprises a plurality of pogo pins; and the plurality of pogo pins are placed in the plane passing through the central axis of the substantially cylindrical cavity.

15. The electronic device of claim 14, wherein:

at least one of the plurality of pogo pins is aligned in a direction substantially orthogonal to a plane tangent to the surface of the cavity.

16. The electronic device of claim 14, wherein:

the plurality of pogo pins is substantially parallel.

17. The electronic device of claim 14, wherein:

a deflecting portion of at least one of the plurality of pogo pins is directed towards the opening of the cavity.

18. A method for manufacturing an electrical connector, comprising:

manufacturing a body having a cylindrical cavity for receiving a cylindrical plug;

defining at least one notch extending through a portion of the body and to the cavity, wherein the at least one notch extends in a plane including a center axis of the cavity;

coupling a pogo pin to the at least one notch, the pogo pin comprising a pogo pin body, an internal spring placed within the pogo pin body, and a deflecting portion electrically coupled to the pogo pin body and biased by the internal spring, wherein the deflecting portion extends in to the cavity; and placing in the body a retention mechanism extending into the cavity, wherein the retention mechanism is operative to engage a recess of the cylindrical plug.

19. The method of claim 18, further comprising:

manufacturing first and second body halves, wherein each of the first and second body halves comprise a portion of the cavity and a portion of the at least one notch; and combining the first and second body halves to form the body.

20. The method of claim 18, wherein:

the pogo pin is coupled to the at least one notch using at least one of a press fit, an adhesive, tape, heat staking and a mechanical transfer.

* * * * *

UNITED STATES PATENT AND TRADEMARK OFFICE

CERTIFICATE OF CORRECTION

PATENT NO. : 7,942,705 B2
APPLICATION NO. : 12/482326
DATED : May 17, 2011
INVENTOR(S) : Sean Murphy et al.

It is certified that error appears in the above-identified patent and that said Letters Patent is hereby corrected as shown below:

In column 7, line 39, in claim 8, delete “electrical” and insert -- electronic --, therefor.

In column 8, line 44-45, in claim 18, delete “in to” and insert -- into --, therefor.

In column 8, line 56, in claim 20, delete “staking” and insert -- staking, --, therefor.

In column 8, line 57, in claim 20, delete “transfer” and insert -- fastener --, therefor.

Signed and Sealed this
Sixth Day of December, 2011

David J. Kappos

David J. Kappos
*Director of the United States Patent and Trademark Office*